US005582116A

United States Patent [19]

Spimpolo

[11] Patent Number: 5,582,116

[45] Date of Patent: Dec. 10, 1996

[54] MODULAR STRUCTURE FURNITURE

[75] Inventor: Pierangelo Spimpolo, Varedo, Italy

[73] Assignee: CLOU Tecnologie d'Arredo S.r.l., Bovisio Masciago, Italy

[21] Appl. No.: 187,284

[22] Filed: Jan. 27, 1994

[30] Foreign Application Priority Data

Jan. 27, 1993 [IT] Italy ..... MI93A0124

[51] Int. Cl.[6] ..... A47B 9/00

[52] U.S. Cl. ..... 108/108; 211/94

[58] Field of Search ..... 108/107, 108, 108/114, 152, 180; 211/94, 94.5, 103, 190, 192; 248/223.4, 225.1, 243

[56] References Cited

U.S. PATENT DOCUMENTS 3,765,344 10/1973 Ferdinand et al. ..... 108/108
3,993,002 11/1976 Stroh ..... 108/108
4,401,222 8/1983 Kulikowski ..... 211/94
5,110,080 5/1992 Rieman ..... 211/94

FOREIGN PATENT DOCUMENTS 1064615 12/1953 France ..... 108/107

*Primary Examiner*—Peter M. Cuomo
*Assistant Examiner*—Gerald A. Anderson
*Attorney, Agent, or Firm*—Sughrue, Mion, Zinn, Macpeak & Seas

[57] ABSTRACT

A modular furniture item is claimed with multiple shelves supported by a risers. The risers are self supporting panels connected to a wall and having supporting feet. Brackets are hooked to the riser to support the shelves thereon. A plurality of self supporting panels are intergrated in a removable manner to form the riser. Each panel has a vertical row of apertures for hooking a bracket so that each shelf is supported by two or more bracket each attached to a separate panel.

15 Claims, 4 Drawing Sheets

MODULAR STRUCTURE FURNITURE

DESCRIPTION

1. Field of application

The present invention relates to a furniture item with modular structure and in particular for furnishing display spaces of the type comprising at least one riser and multiple shelves.

The present invention concerns specifically but not exclusively a furniture item designed for furnishing merchandising and/or trade areas and the following description is made with reference to this field of application with the only purpose of simplifying the explanation thereof.

2. Prior art

As is known, the furniture market now offers a plurality of solutions for adequately furnishing display spaces for the most varied businesses.

For example, depending on the requirements of individual business, it is possible to meet with especially economical solutions such as for example shelving in various styles and sizes or in display furnishings especially designed with special care for good appearance.

In the former case economy of the solution is given priority at the expense of the quality and overall pleasantness of that which is displayed to the public.

In the latter case considerable costs must be borne to adequately equip display spaces capable by themselves of attracting public attention apart from the type of products displayed. In this specific area the market offerings are turning toward those particularly functional and rational solutions consisting of the so-called equipped walls.

But it is clear that the costs of employment of this type of furnishing are considerable and especially if related to their actual capacity for support and containment of goods.

Indeed, it must be remembered that the reseller of this type of furnishing is often forced to bear high costs to keep a store of component parts thereof. This also considerably reduces the margin of profit of the reseller who then seeks to make up the difference with the manufacturer.

In addition, known types of furnishings actually have a modular sectional structure but this does not result in a smaller number of component parts.

The technical problem underlying the present invention is to conceive a furniture item with modular structure having structural and functional characteristics allowing on the one hand equipping display spaces in a simple and functional manner while giving also particular aesthetic value and on the other hand reducing to a minimum the cost of stocking the component parts of the furniture item and thus meeting the requirements of resellers.

Another purpose of the present invention is to conceive a furniture item with modular structure having particularly low production costs.

SUMMARY OF THE INVENTION

The solution idea underlying the present invention is to provide the furniture item with a very small number of different component parts.

On the basis of this solution idea the technical problem is solved by a furniture item of the type indicated above and characterised in that said riser is a self-bearing panel to be associated with a wall and that said shelves are consoles supported in a cantilevered manner by brackets hooked to the panel and said riser and said brackets have respective quick hook coupling and said means are aligned longitudinally along the riser.

In a preferred embodiment multiple panels are fastened to a wall and brought together and multiple bracket pairs associated with corresponding consoles are hooked by snapping to adjacent panels or spaced the width of one or more risers.

The characteristics and advantages of the furniture item in accordance with the present invention are set forth in the description of an embodiment thereof given below by way of non limiting example with reference to the annexed drawings.

DETAILED DESCRIPTION

Figure 1:
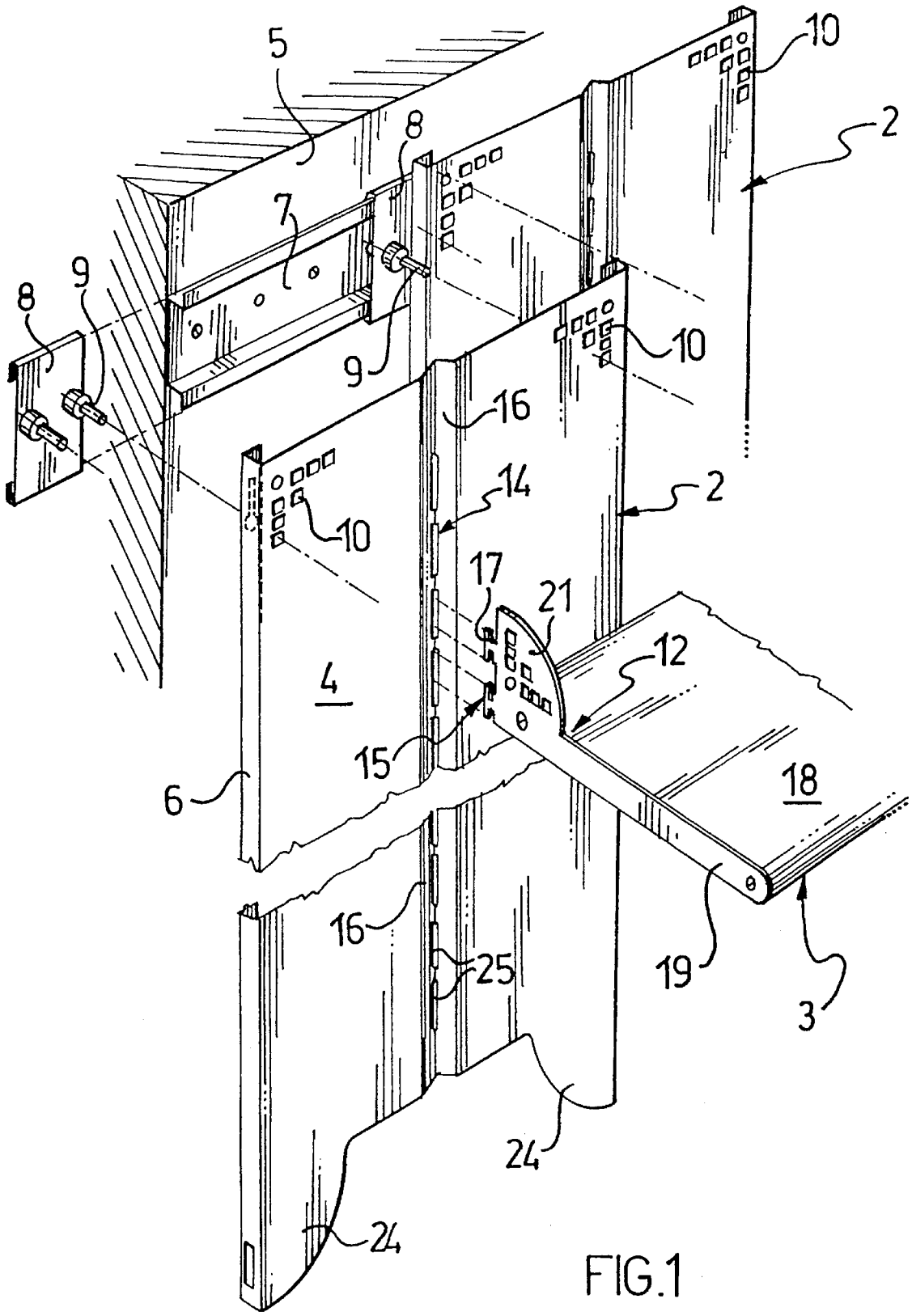
FIG. 1 shows a perspective view with detached parts of the furniture item in accordance with the present invention.
Figure 2:
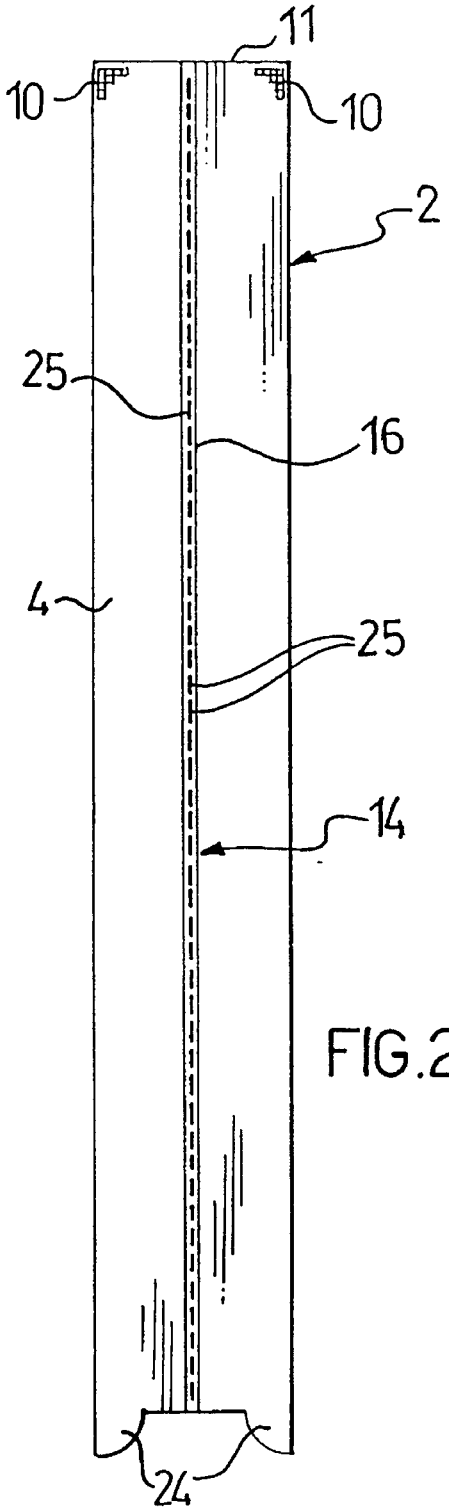
FIG. 2 shows a front view of a riser of the furniture item of FIG. 1.
Figure 3:
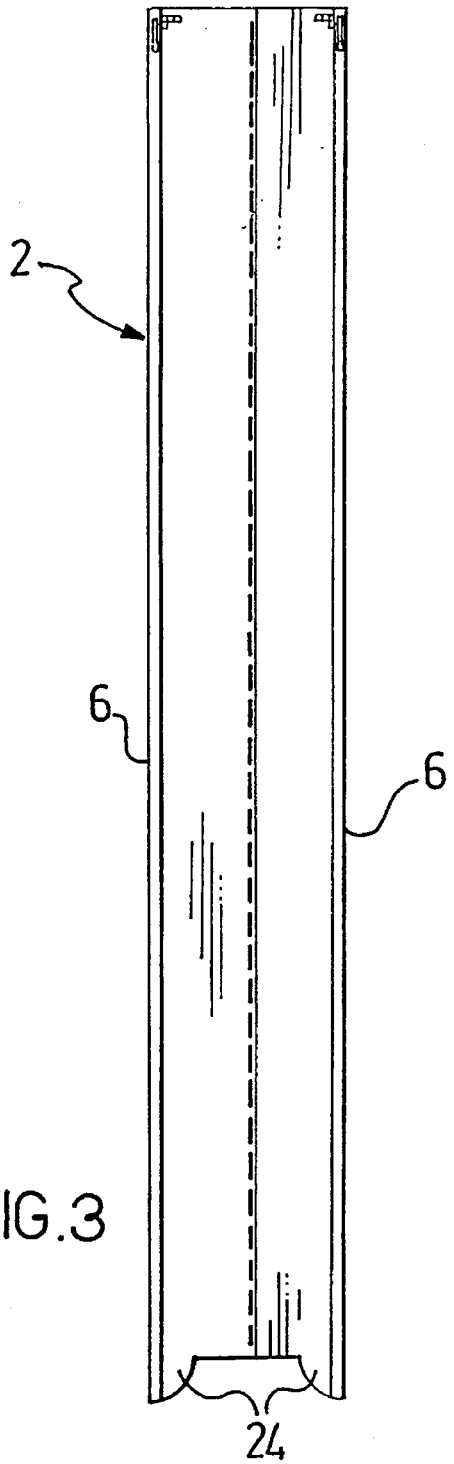
FIG. 3 shows a rear view of the riser of FIG. 2.

With reference to the above figures, reference number 1 designates as a whole a furniture item with modular structure provided in accordance with the present invention.

The furniture item 1 is designed in particular but not exclusively for furnishing commercial display spaces. Obviously nothing prohibits using the furniture item in accordance with the present invention in domestic environments.

The furniture item 1 has an especially simple structure and comprises at least one riser 2 and multiple shelves 3.

The riser 2 is a self-bearing or self supporting panel 4 provided preferably of sheet metal and with a length greater than its width.

In a preferred embodiment said sheet metal is precoated with a synthetic plastic material capable of giving the riser 2 an especially good appearance. Obviously the sheet metal can also be merely painted or treated with anticorrosion processes.

Figure 4:
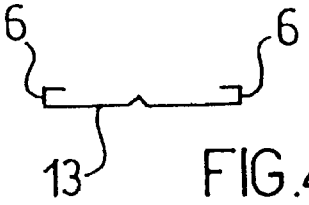
FIG. 4 shows a cross section view of the riser of FIG. 2.

In addition, the panel 4 has a basically boxed structure having the cross section shape shown in FIG. 4. Said cross section shows a front wall 13 and side edges 6 provided with a reverse bend. The rear side of the panel 4 is essentially open.

The panel 4 is installed by associating it with or fastening it to a free wall 5 of a room to be furnished.

Figure 5:
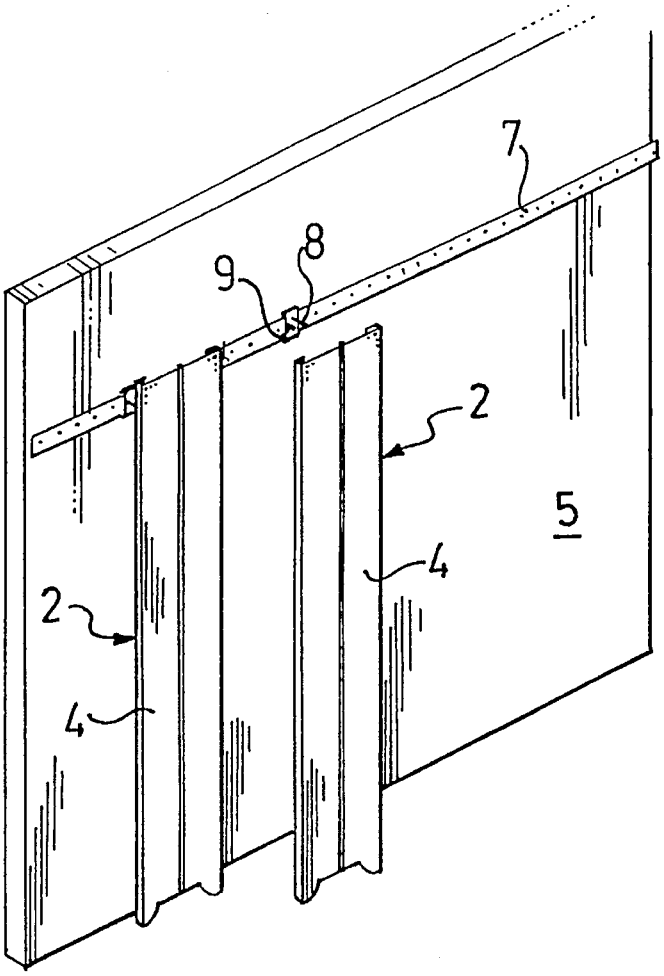
FIG. 5 shows a perspective view of a pair of risers of FIG. 2 under employment conditions.
Figure 6:
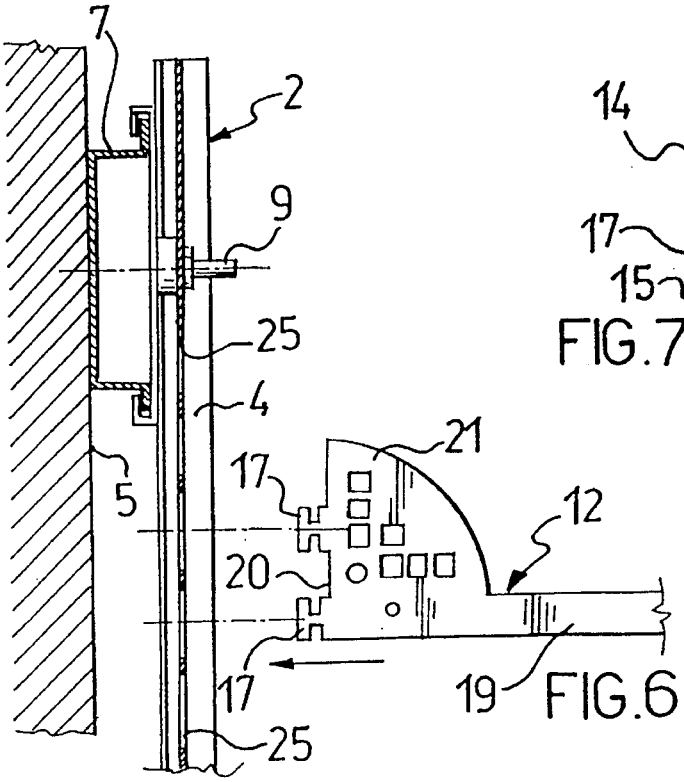
FIGS. 6 and 7 show longitudinal cross section views of a detail of the furniture item in accordance with the present invention in two different assembly phases.
Figure 7:
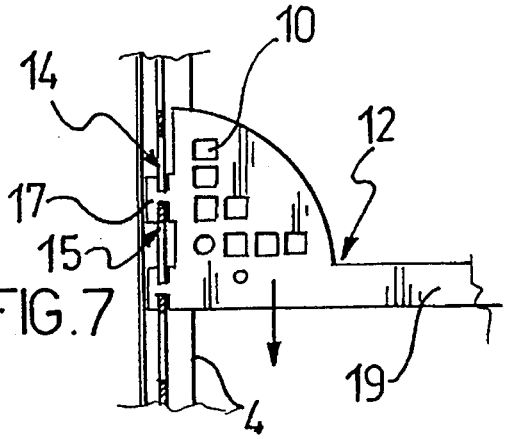

Advantageously, in accordance with a preferred embodiment, multiple panel bodies 4 are fastened to the wall 5 while placing them near together and mutually integrated in such a manner as to provide a sort of back as shown in FIG. 5.

For this purpose there can be used conventional fastening means. In greater detail, in the embodiment described there is used a rail 7 fastened horizontally to the wall 5 at a height almost that of the panel bodies 4. On said rail 7 are mounted in a running manner plates 8 equipped with fastening pins 9 projecting perpendicularly thereto.

Each panel 4 has it upper end 11 equipped with bores 10 provided near upper edges. Through said bores 10 there is access to said fastening pins 9 which allow constraint in a removable manner of the panel to the wall 5.

The lower end of the panel is shaped with a pair of opposing support feet 24.

As already mentioned, the furniture item 1 comprises multiple shelves 3. Said shelves 3 are consoles 18 supported in cantilevered manner by brackets 12 hooked in a removable manner to the panel 4. The consoles 18 and brackets 12 are mutually integral.

Advantageously the riser 2 and the brackets 12 are equipped with respective means 14 and counter-means 15 of quick hook coupling.

The means 14 are aligned longitudinally along the riser from the upper end thereof to the lower end thereof.

More in particular, the means 14 are holes 25 of essentially rectangular elongated form provided in a groove 16 made centrally and longitudinally in the panel 4. Preferably said groove 16 has a cross section like the letter V.

The counter-means 15 associated with each bracket 12 comprise a pair of hooks 17 shaped essentially like the letter T and positioned in mutually spaced relation in such a manner that they can engage two corresponding holes 25 in the groove 16.

The brackets 12 have the form of a triangle with a long arm 19 fastened to a corresponding side edge of the console 18 and a short arm 20 extending perpendicularly to the former and made in a single piece therewith. In this specific case, the two arms 19 and 20 are filleted together by a flange 21 shaped like a circular segment and having an ornamental motif.

The hooks 17 are made in a single piece with the short arm 20 of each bracket 12.

The consoles 18 can obviously have different, modular lengths. Therefore, pairs of brackets 12 associated with corresponding consoles 18 can be hooked by snapping between grooves 16 of adjacent panels bodies or spaced from each other the width of one or more risers 2.

Figure 8:
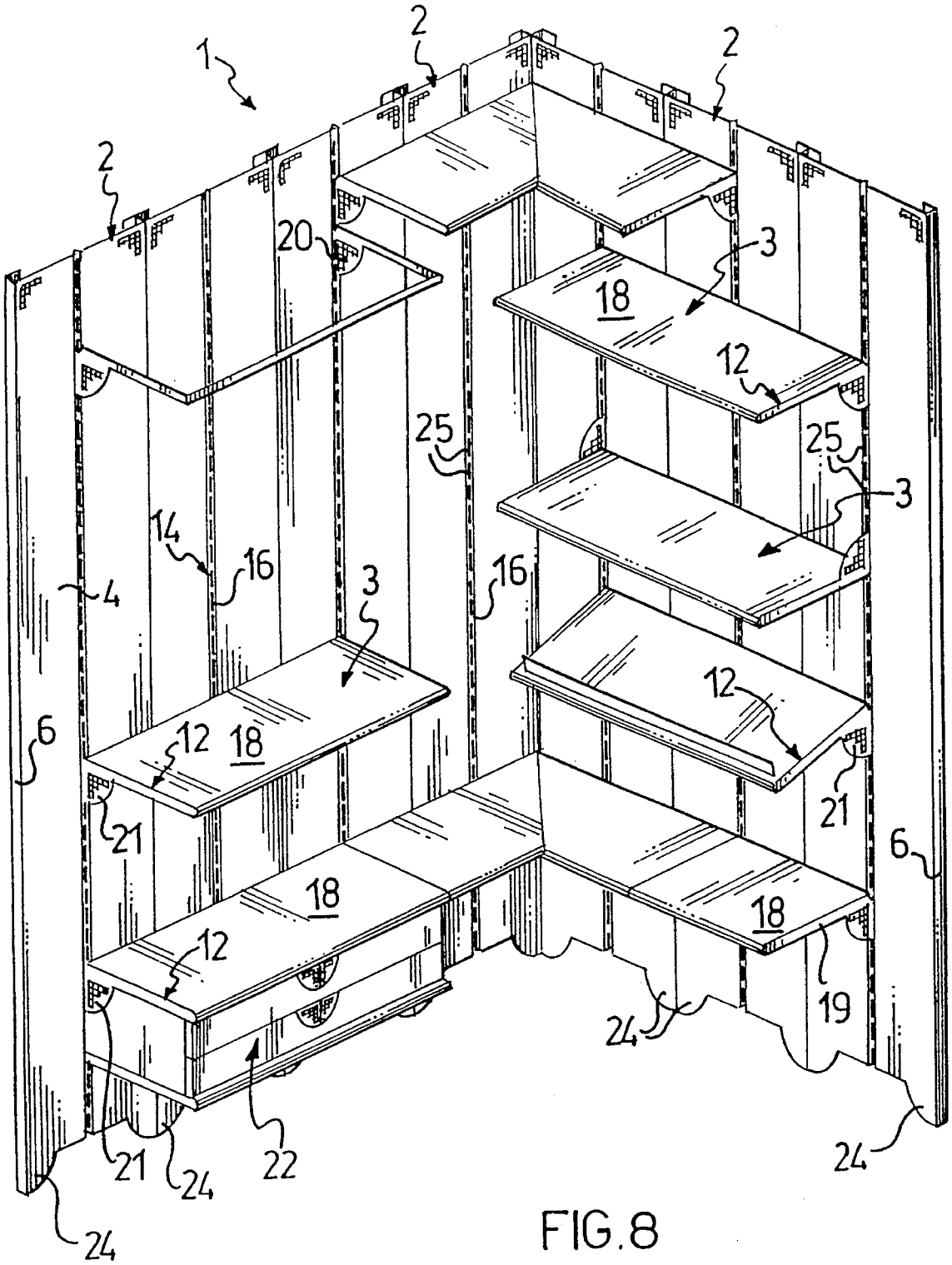
FIG. 8 shows a front perspective view of the furniture item in accordance with the present invention in assembled form.

In addition, thanks to the special conformation like the letter T of the hooks 17, the consoles 18 can be hooked to the panels bodies 4 even in overturned position and in this case the flange 21 is useful as a side board of the supporting surface consisting of the shelf as shown in FIG. 8.

The consoles 18 can also be structured and/or made integral with furnishings such as drawers 22, hanging units, etc., as shown in FIG. 8.

From the above description it is clear that the furniture item 1 meets the purposes pre-set for the present invention.

In particular, it has a particularly simple and functional structure as well as very low cost.

The different component parts of the furniture item are effectively reduced to the minimum. In addition, they can be stored with very low space occupied and cost.

The self-bearing sheet metal panels can also be electrified with low voltage making it possible to associate with the furniture in accordance with the present invention lighting fixtures to improve the functionality thereof for display purposes.

The particular structure of the present invention facilitates installation and thus drastically reduces labour time and cost. In addition, the extreme versatility of the system proposed here makes it universally suited for employment in any type of commercial establishment.

The furniture item in accordance with the present invention also gives especially good appearance to the rooms where it is assembled and installed.

Modifications and variations can be made to the furniture item while falling within the scope of the present invention as defined in the following claims.

I claim:

1. Furniture item (1) with modular structure and in particular for furnishing display spaces and of the type comprising at least one riser (2) and multiple shelves (3) wherein said riser is a self-supporting panel (4) adapted to be connected to a wall (5) and said shelves are consoles (18) supported in a cantilevered manner by brackets (12) hooked to the panel (4) and said riser and said brackets having respective hooking means (14) and counter-means (15) for quick hook coupling with said hooking means (14) being aligned longitudinally along the riser (2) and wherein said panel (4) has its lower end shaped with supporting feet (24).

2. Furniture item in accordance with claim 1 characterised in that said hooking means (14) are elongated rectangular holes (25) extending in longitudinal alignment from the upper end (11) to the lower end of the riser (2).

3. Furniture item in accordance with claim 1 characterised in that said hooking means (14) are provided in a groove (16) disposed centrally and longitudinally in the panel (4).

4. Furniture item in accordance with claim 3 characterised in that said groove (16) has a cross section in the form of the letter V.

5. Furniture item in accordance with claim 1 characterised in that said panel (4) has only its upper end equipped with wall hooking means (10).

6. Furniture item in accordance with claim 5 characterised in that said wall hooking means are bores (10) for engagement of corresponding fastening pins (9) projecting from respective plates (8) guided in a running manner on a rail (7).

7. Furniture item in accordance with claim 1 characterised in that said brackets (12) have the form of a triangle with a long arm (19) fixed to a corresponding side edge of the console (18) and a short arm (20) extending perpendicularly to the former.

8. Furniture item in accordance with claim 7 characterised in that the two arms (19,20) are mutually filleted by a flange (21) having the shape of a circular segment.

9. Furniture item in accordance with claim 1 characterised in that said panel (4) is provided in sheet metal.

10. Furniture item in accordance with claim 9 characterised in that said sheet metal is pre-coated.

11. Furniture item in accordance with claim 9 characterised in that said sheet metal is reversely bent to form the side edges (6) of the panel body.

12. Furniture item in accordance with claim 1 characterised in that said brackets have the end for attachment to the riser equipped with a pair of hooks (17).

13. Furniture item in accordance with claim 12 characterised in that said hooks ( 17 ) are shaped essentially like the letter T.

14. Furniture item in accordance with claim 1 wherein said furniture item comprises a plurality of said panels (4) integrated in a removable manner in mutual proximity as well as multiple pairs of brackets (12) associated with corresponding shelves (18) hooked by snapping to said panels (4).

15. Furniture item in accordance with claim 1 characterised in that said consoles (18) are integral with the brackets (19).

* * * * *